US007118327B2

(12) United States Patent
Doering et al.

(10) Patent No.: US 7,118,327 B2
(45) Date of Patent: Oct. 10, 2006

(54) IMPELLER AND CUTTING ELEMENTS FOR CENTRIFUGAL CHOPPER PUMPS

(75) Inventors: Brandon R. Doering, West Jordan, UT (US); James C. Harmon, Salt Lake City, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 136 days.

(21) Appl. No.: 10/893,506

(22) Filed: Jul. 16, 2004
(Under 37 CFR 1.47)

(65) Prior Publication Data

US 2005/0053461 A1 Mar. 10, 2005

Related U.S. Application Data

(60) Provisional application No. 60/488,504, filed on Jul. 18, 2003.

(51) Int. Cl.
*F04D 29/70* (2006.01)

(52) U.S. Cl. ..... 415/121.1; 415/121.2

(58) Field of Classification Search ..... 415/121.1, 415/212.2, 174.5, 230; 241/84, 91, 188.2, 241/191
See application file for complete search history.

(56) References Cited

U.S. PATENT DOCUMENTS 2,712,416 A * 7/1955 Beushausen et al. ..... 241/55
2,824,702 A * 2/1958 Lee ..... 241/46.013
2,975,714 A * 3/1961 Nechine ..... 241/46.02
3,155,046 A 11/1964 Vaughan
3,774,323 A 11/1973 Vaughn
3,973,866 A 8/1976 Vaughan
4,527,947 A 7/1985 Elliott
4,840,384 A 6/1989 Dorsch
4,842,479 A 6/1989 Dorsch
5,076,757 A 12/1991 Dorsch
5,256,032 A 10/1993 Dorsch
5,456,580 A 10/1995 Dorsch
5,460,482 A 10/1995 Dorsch
5,460,483 A 10/1995 Dorsch
6,190,121 B1 2/2001 Hayward et al.
6,224,331 B1 5/2001 Hayward et al.

* cited by examiner

*Primary Examiner*—Ninh H. Nguyen
(74) *Attorney, Agent, or Firm*—Morriss O'Bryant Compagni, P.C.

(57) ABSTRACT

A pump impeller and associated cutting elements are disclosed which are especially designed and positioned near the periphery of the impeller to reduce the size of entrained solids in a pumped fluid, or slurry, and to expel such solids from the impeller, drive shaft and associated sealing mechanisms.

23 Claims, 5 Drawing Sheets

IMPELLER AND CUTTING ELEMENTS FOR CENTRIFUGAL CHOPPER PUMPS

CROSS-REFERENCE TO RELATED APPLICATION

This application is a non-provisional application claiming priority to provisional patent application Ser. No. 60/488,504 filed Jul. 18, 2003.

BACKGROUND OF THE INVENTION

1. Field of the Invention

This invention relates to centrifugal pumps of the type known as chopper pumps, which are structured to process fluids containing large-sized solids that must be cut or chopped by the pump. Specifically, this invention relates to an impeller and associated cutting elements which are configured to process entrained solids and exclude them from the area of the seal of the pump.

2. Description of Related Art

Centrifugal pumps of the chopper type are used in many and varied industries to process fluids that contain larger-sized solids, such as plastics or animal byproducts. Chopper pumps are typically characterized by having an impeller that is structured to contact a cutting element positioned adjacent the vanes of the impeller to exert a cutting or chopping action on the solid material entering the pump. The impeller and cutting structures positioned on the suction side of chopper pumps processes the majority of the solids content to a size that can be moved through the pump. However, some solids tend to also move toward the drive side of the impeller and may move inwardly toward the drive shaft of the pump.

When solids move toward the drive side, or back, of the impeller and inwardly toward the drive shaft, debris can become wrapped around the drive shaft and impede the operation of the pump. This is especially the case with fluids containing stringy solids. Debris behind the impeller can cause a build up in heat and wear on the impeller and can impede the cooling and lubrication of the seal elements. Solid material may infiltrate the seal and cause further problems with pump operation. Thus, some known chopper pumps have employed flushing mechanisms to clean behind the impeller.

Other known chopper pumps have used impellers designed with cutting elements located on or near the back side of the impeller and about the drive shaft to chop solid material in the location of the drive shaft. An example of an impeller and cutting element of the type described is disclosed in U.S. Pat. No. 5,460,482 to Dorsch. Some chopper pumps also use restrictor bushings around the shaft to keep larger solids away from the seal, as described in the '482 patent to Dorsch. Yet other chopper pumps use an open impeller design to reduce pressure behind the impeller so that solids are not drawn toward the back side of the impeller.

Prior art chopper pumps which employ a cutting element on the back side of the impeller require that the cutting element be positioned adjacent the impeller hub and/or in very close proximity to the drive shaft. As such, debris in the fluid, especially stringy material, can infiltrate all the way to the drive shaft and seal assembly before any chopping or cutting of the material takes place.

Thus, it would be advantageous in the art to provide an impeller and cutting element configuration in a centrifugal chopper pump that processes and excludes debris from behind the impeller before the debris can reach the drive shaft and seal assembly, thereby improving pump operation and the life of the pump.

BRIEF SUMMARY OF THE INVENTION

In accordance with the present invention, an impeller and cutting elements are positioned relative to the drive shaft of the pump and are configured to interact in a manner that chops or cuts debris near the peripheral edge of the drive side of the impeller to effectively reduce and exclude debris from contact with the drive shaft and any associated sealing assemblies. While the impeller and cutting elements of the present invention are described herein with respect to use in centrifugal pumps of the chopper type, the impeller and cutting elements may be adapted for use in types of centrifugal pumps other than chopper pumps.

The present invention comprises an impeller, having a drive side oriented away from the inlet of the pump, which is particularly configured with cutting structures that interact with cutting elements positioned adjacent to the drive side of the impeller. The cutting structures particularly comprise cutting elements that are positioned toward the outer periphery of the impeller to provide chopping and cutting of solids near the periphery of the impeller. The peripherally-located cutting elements are also structured and placed to exclude the chopped debris from the drive side of the impeller, and especially away from the drive shaft and any associated sealing assemblies.

The impeller may also include debris excluding structure that is located nearer to the central axis of the impeller, toward a central opening of the impeller, to exclude any residual or errant solid debris from infiltrating beyond the peripherally-located cutting elements. The debris excluding structure positioned nearer to the central axis of the impeller may be configured as a labyrinth element positioned proximate the drive shaft to prevent debris from reaching the drive shaft and seals of the pump.

The present invention further comprises cutting structures that are positioned adjacent to the drive side of the impeller to interact with the cutting structures that are formed on the drive side of the impeller. The adjacently positioned, interacting cutting structures may form a part of the pump casing of the pump, such as a drive side casing or an end plate structure attached to the pump casing.

Alternatively, and as particularly described herein, the adjacently positioned cutting structures may be formed as part of a separate back plate that is positioned between the pump casing and the drive side of the impeller. Providing the adjacently positioned cutting structures on a separate plate-like structure, attachable to and separate from the pump casing, has the particular advantage of enabling removal of the back plate from the pump casing for ease of replacement when the cutting structures become worn. A particularly suitable back plate is described herein which is further structured to provide additional sealing of the drive shaft and sealing assemblies from any debris that may infiltrate the drive side of the impeller.

The impeller, with its cutting elements, and the interacting cutting elements provided on the pump casing or back plate comprise an impeller assembly of the present invention that may be adapted to various types of pumps. The impeller assembly of the present invention provides certain advantages to operation of the pump as will become more evident with a more complete description of the invention which follows.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
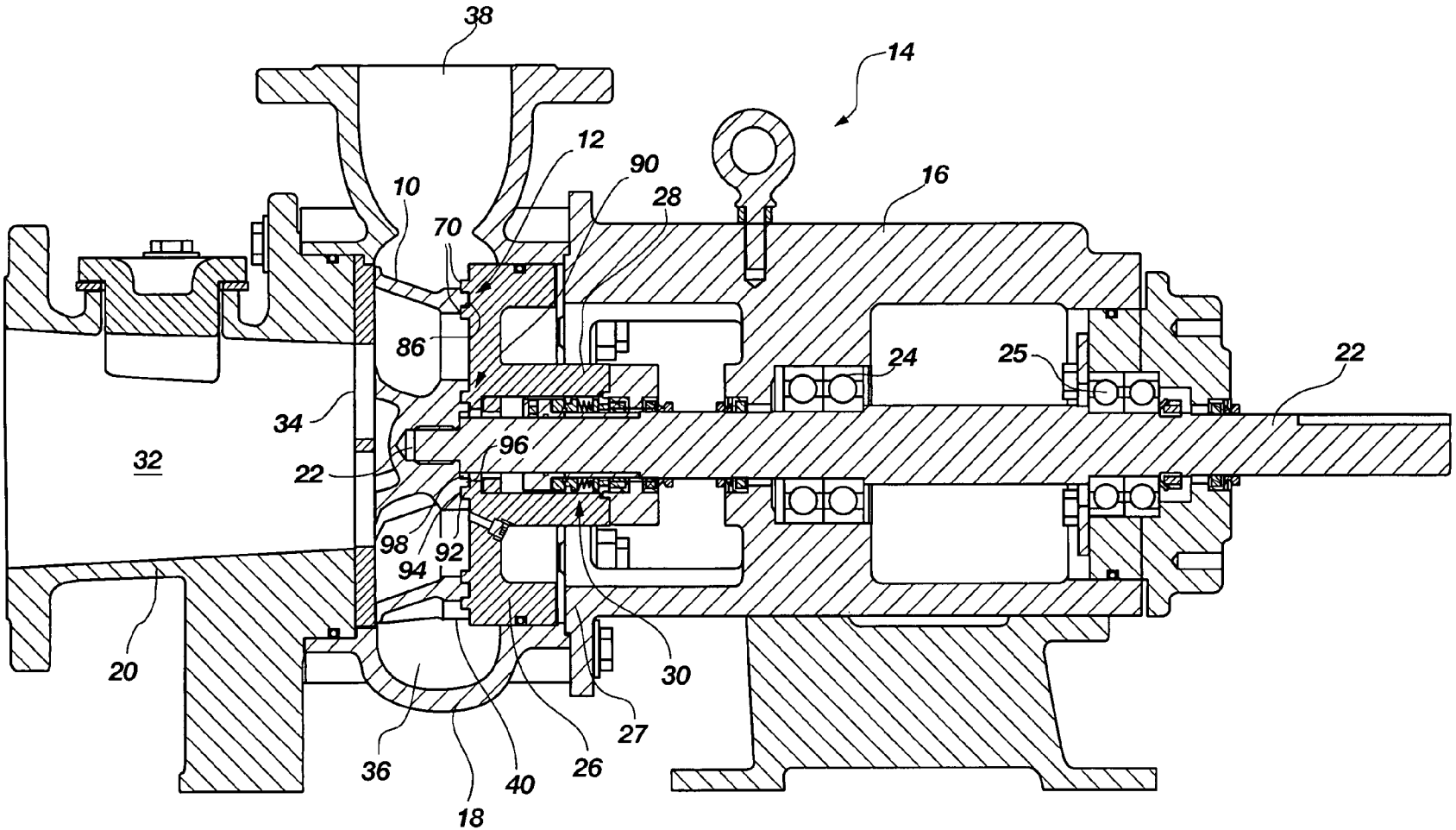
FIG. 1 is a view in longitudinal cross section of a centrifugal pump of the chopper type illustrating the impeller assembly of the present invention.

FIG. 1 illustrates in longitudinal cross section one exemplar configuration of a centrifugal chopper pump constructed with the impeller 10 and cutting elements 12 of the present invention. The centrifugal chopper pump 14 generally comprises a pump casing that is shown in FIG. 1 as comprising a drive casing 16, a volute casing 18 that is secured to the drive casing 16, and a suction casing 20 that is secured to the volute casing 18.

The drive casing 16 is generally structured to receive a drive shaft 22 which extends through the drive casing 16 and into the volute casing 18. Bearing assemblies 24 and 25 are generally positioned within the drive casing 16 to support the drive shaft 22. The drive shaft 22 extends through the drive casing 16 and is attached to the impeller 10, which is positioned within the volute casing 18.

The drive shaft 22 may also extend through a back plate 26 that is positioned between the drive casing 16 and impeller 10. The back plate 26 is shown secured to an end wall 27 of the drive casing 16, but may be secured to any suitable structure of the pump 14 or portion of the pump casing. The back plate 26 may be of any suitable configuration that provides adjacent positioning of cutting elements to interact with the impeller 10, as described more fully hereinafter. The back plate 26 illustrated in FIG. 1 is configured with an annular collar 28 that extends through the end wall 27 of the drive casing 16 and is structured to house a sealing mechanism 30 positioned about the drive shaft 22.

In operation, fluid containing larger-sized solids enters into the pump 14 through an inlet 32 in the suction casing 20. The fluid and solids enter through an intake or chopper plate 34 that is positioned between the suction casing 20 and the impeller 10. As described more fully hereinafter, the impeller 10 interacts with the chopper plate 34 to cut and chop the solids in the fluid. The fluid and solids slurry then flows into the volute 36 of the pump 14 from where it is expelled through the outlet 38 of the pump 14.

It can be appreciated from the view of FIG. 1 that as the fluid and solids slurry moves into the volute 36, the fluid has a tendency to impact the rear portion 40 of the impeller 10 where it rotates along the back plate 26. It should be noted that the size, dimension and position of the impeller 10 and back plate 26 as shown in FIG. 1 is merely by way of example to illustrate the structures of the invention, and the axial extension of the rear portion 40 of the impeller 10 into the volute 36 may not be as pronounced as illustrated in FIG. 1. Nonetheless, fluid and debris can move behind the impeller, and potentially infiltrate to the drive shaft 22 and sealing mechanism 30 of the pump 14. Thus, the present invention provides a structured impeller assembly having associated cutting elements which are especially designed to providing cutting action of any debris that may initiate entry behind the impeller 10.

Figure 2:
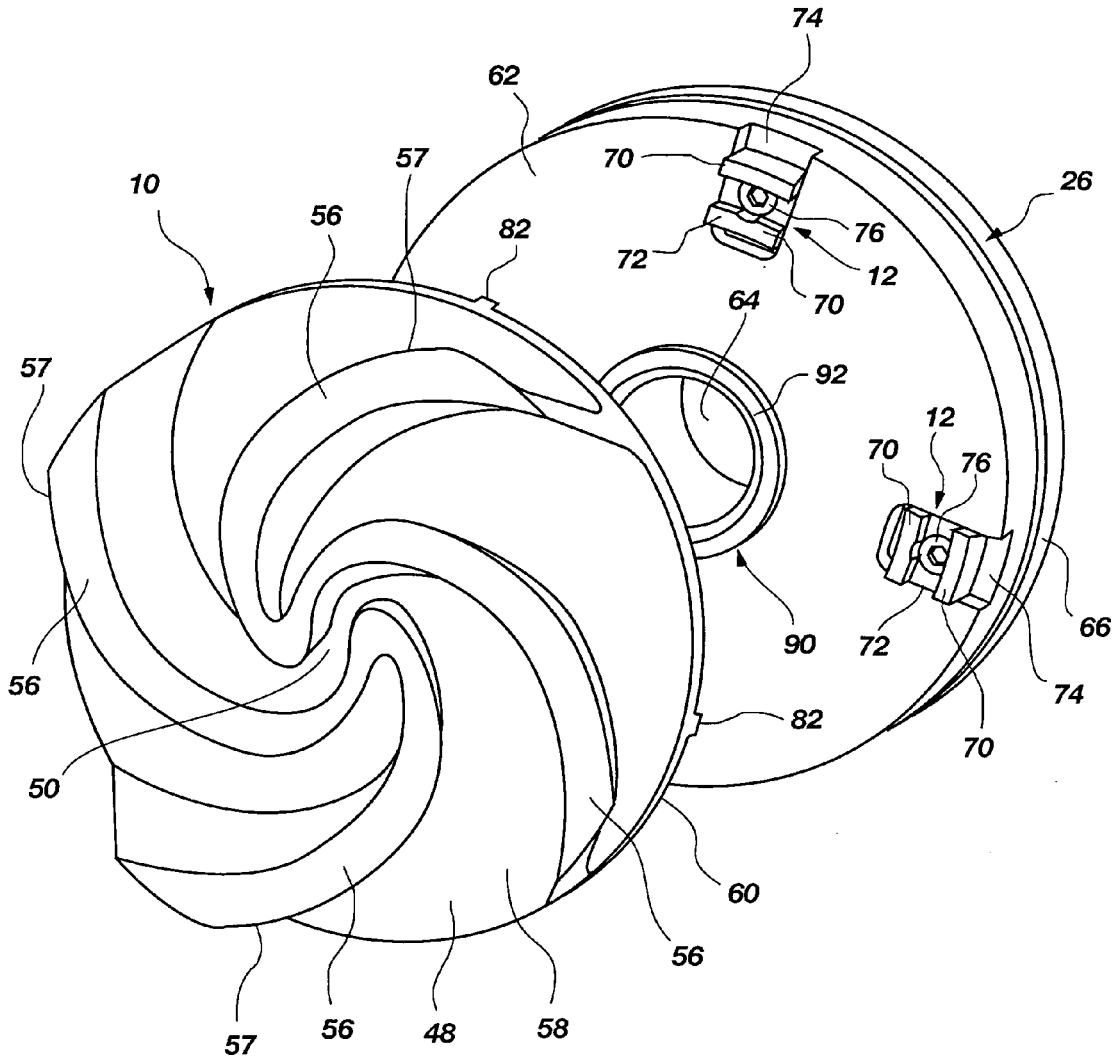
FIG. 2 is a perspective and exploded view of the suction side of an impeller and back plate of a chopper pump in accordance with the present invention.
Figure 3:
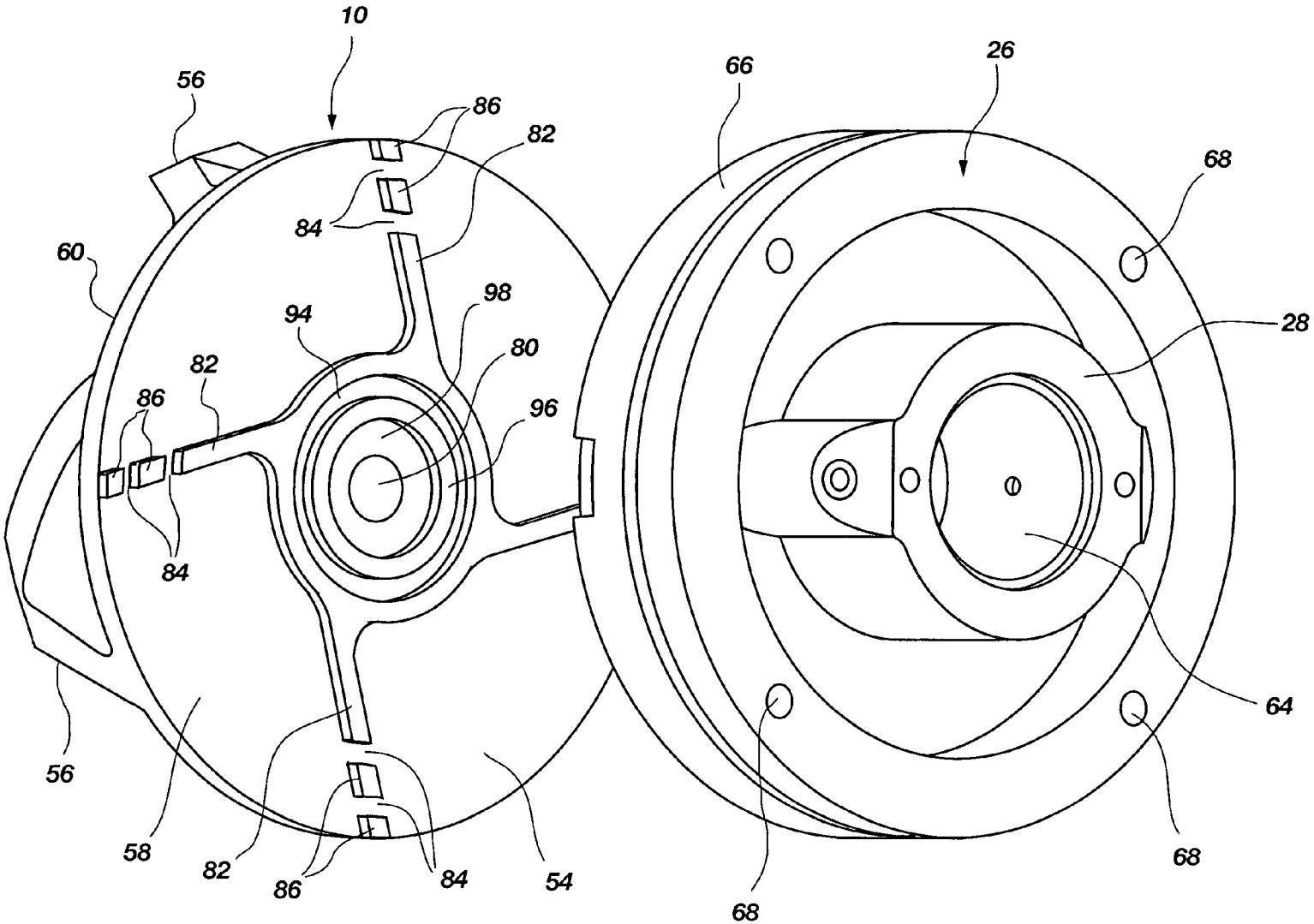
FIG. 3 is a perspective and exploded view of the drive side of an impeller and back plate of a chopper pump in accordance with the present invention.

A first embodiment of the impeller 10 of the present invention is illustrated in further detail in FIGS. 2 and 3. FIG. 2 is a perspective view of the impeller 10 viewed from the suction side 48 and eye 50 of the impeller 10. The impeller 10 is shown at a spaced distance from the back plate 26 of the pump to illustrate the detail of the back plate 26. FIG. 3 is a perspective view of the drive side surface 54 of the impeller 10 as shown spaced from the back plate 26, the drive side view of which is also shown.

As seen in FIG. 2, the impeller 10 comprises a plurality of vanes 56 which radiate outwardly from the eye 50 of the impeller 10. Each vane 56 has a cutting edge 57 that is positioned in close tolerance with the chopper plate 34 (FIG. 1) to effect cutting of solids. In this particular embodiment of the invention, the impeller 10 is formed with a shroud 58 which is oriented to be positioned adjacent the back plate 26 when assembled in the pump. The vanes 56 extend axially outwardly from the shroud 58 in a direction away from the back plate 26. The shroud 58 has a circumferential edge 60 which defines the periphery of the impeller 10 and which is oriented toward the volute 36 of the pump 14.

As also seen in FIG. 2, the back plate 26 is structured with a disc-like front face 62 having a central opening 64 through which the drive shaft 22 extends to engage the impeller 10 (FIG. 1). The back plate 26 has a circumferential edge 66 which is generally sized to be received within the volute casing 18, as shown in FIG. 1. As best seen in FIG. 3, the back plate 26 is further structured with an annular collar 28 that extends into the drive casing 16, as shown also in FIG. 1. The back plate 26 is also structured with holes 68 positioned to receive bolts or other securement means for securing the back plate 26 to the drive casing 16.

Referring again to FIG. 2, the back plate 26 is provided with at least one cutting element 12 located near the circumferential edge 66 of the back plate 26. Two cutting elements 12 are shown in the view of FIG. 2. The cutting elements 12 may be structured in the form of studs 72 having back plate cutter teeth 70. In this embodiment, the studs 72 are received in recessed slots 74 formed in the front face 62 of the back plate 26. The studs 72 are attached to the back plate 26 by appropriate securement means, such as a bolt 76. The studs 72 are, therefore, replaceable when worn. Alternatively, however, the cutting elements 12 may be integrally formed with the back plate 26 and when worn, the back plate 26 may be replaced.

Figure 4:
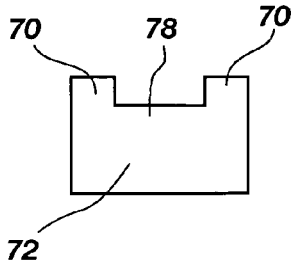
FIG. 4 is a side view in elevation of a cutting element of the present invention.

The studs 72 are most suitably hardened by known methods in the art to render them resistant to wear, thereby extending the service life of the back plate cutter teeth 70. FIG. 4 is a side view of a stud 72 showing more particularly that the stud 72 is formed with a body 78 portion and the back plate cutter teeth 70 extend outwardly from the body portion 78. The body portion 78 is sized to be received in a recessed slot 74 of the back plate 26.

Referring to FIG. 3, the impeller 10 is formed with a central opening 80 which is configured to receive the terminal end of the drive shaft 22, as shown in FIG. 1. Radiating outwardly from near the central opening 80 may be a plurality of expeller vanes 82. The expeller vanes 82 extend axially outward from the drive side surface 54 of the impeller 10 in the direction of the back plate 26. The expeller vanes 82 are positioned and configured to facilitate the movement of fluid and solids away from the center of the impeller 10 near the drive shaft.

Figure 5:
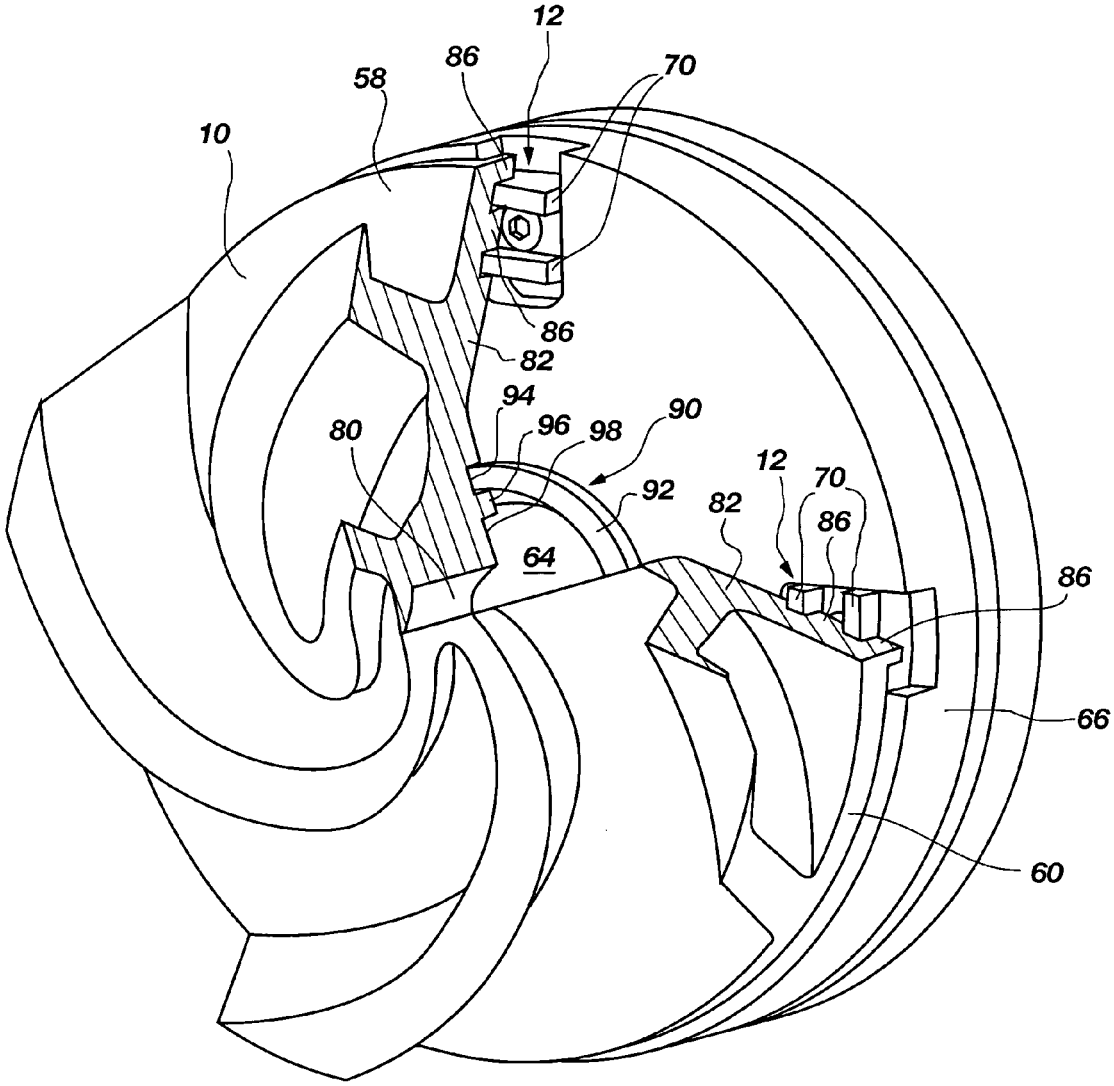
FIG. 5 is a perspective view in partial cutaway of the impeller and back plate shown in FIG. 2 when assembled within the pump.

In the particular embodiment of the invention shown in FIG. 3, each expeller vane 82 is structured with indentations 84 near the periphery or circumferential edge 60 of the shroud 58. The indentations 84 further define outwardly extending portions that form cutter teeth 86 on the drive side surface 54 of the impeller 10. As best seen in FIG. 5, when the impeller 10 is positioned adjacent the back plate 26 in assembly of the pump, the cutter teeth 86 of the impeller 10 are positioned to move between the back plate cutter teeth 70 as the impeller 10 rotates relative to the back plate 26. The impeller cutter teeth 86 are most suitably hardened to render them resistant to wear.

The interaction or meshing of the impeller cutter teeth 86 and the back plate cutter teeth 70 provides a cutting action on any debris that begins to infiltrate between the drive side surface 54 of the impeller 10 and the back plate 26. The cutting action, most importantly, takes place at the periphery of the impeller 10 and back plate 26, thereby reducing the likelihood that debris will infiltrate all the way to the center of the impeller 10 near the drive shaft. As noted before, the expeller vanes 82 further operate to exclude debris from behind the impeller 10.

It should further be noted that the impeller cutter teeth 86 are illustrated here as being part of the expeller vanes 82 (i.e., in radial alignment or extension with the expeller vanes 82). However, cutter teeth 86 that extend axially from the shroud 58 may be formed near the periphery of the impeller in positions other than as a radial extension of the expeller vanes 82, as long as they are positioned to mesh or interact with the back plate cutter teeth 70. The impeller cutter teeth 86 may also be detachably attached members in a manner similar to the studs 72 on the back plate 26.

The present invention further deters debris from infiltrating near the drive shaft 22 or the sealing mechanism 30 of the pump 14 by providing a debris excluding structure, shown as a labyrinth 90, near the center axis of the impeller 10 and back plate 26, as best seen in FIG. 5. The labyrinth 90 comprises a ring 92 which extends axially outwardly from the front face 62 of the back plate 26. As best seen in FIG. 3, the impeller 10 is further configured with an annular channel 94 in which the ring 92 is received when the impeller 10 and back plate 26 are assembled in the pump (FIGS. 1 and 5). The impeller 10 is further configured with an annular ring 96 surrounding the central opening 80 of the impeller 10 (FIG. 3) which extends axially outward from the drive side surface 54 of the impeller 10.

An annular shoulder 98 extends radially from the central opening 80 to the annular ring 96 of the impeller 10. Thus, as best seen in FIGS. 1 and 5, any debris that may have infiltrated from the circumferential edge 60 of the impeller 10 or periphery toward the center of the impeller 10 is presented with a labyrinth 90 having four ninety degree turns through which the debris and fluid must move in order to reach the drive shaft 22 and the sealing mechanism 30. Accordingly, the likelihood that any debris will reach the drive shaft 22 or sealing mechanism 30 is rendered very remote.

Figures 6, 7:
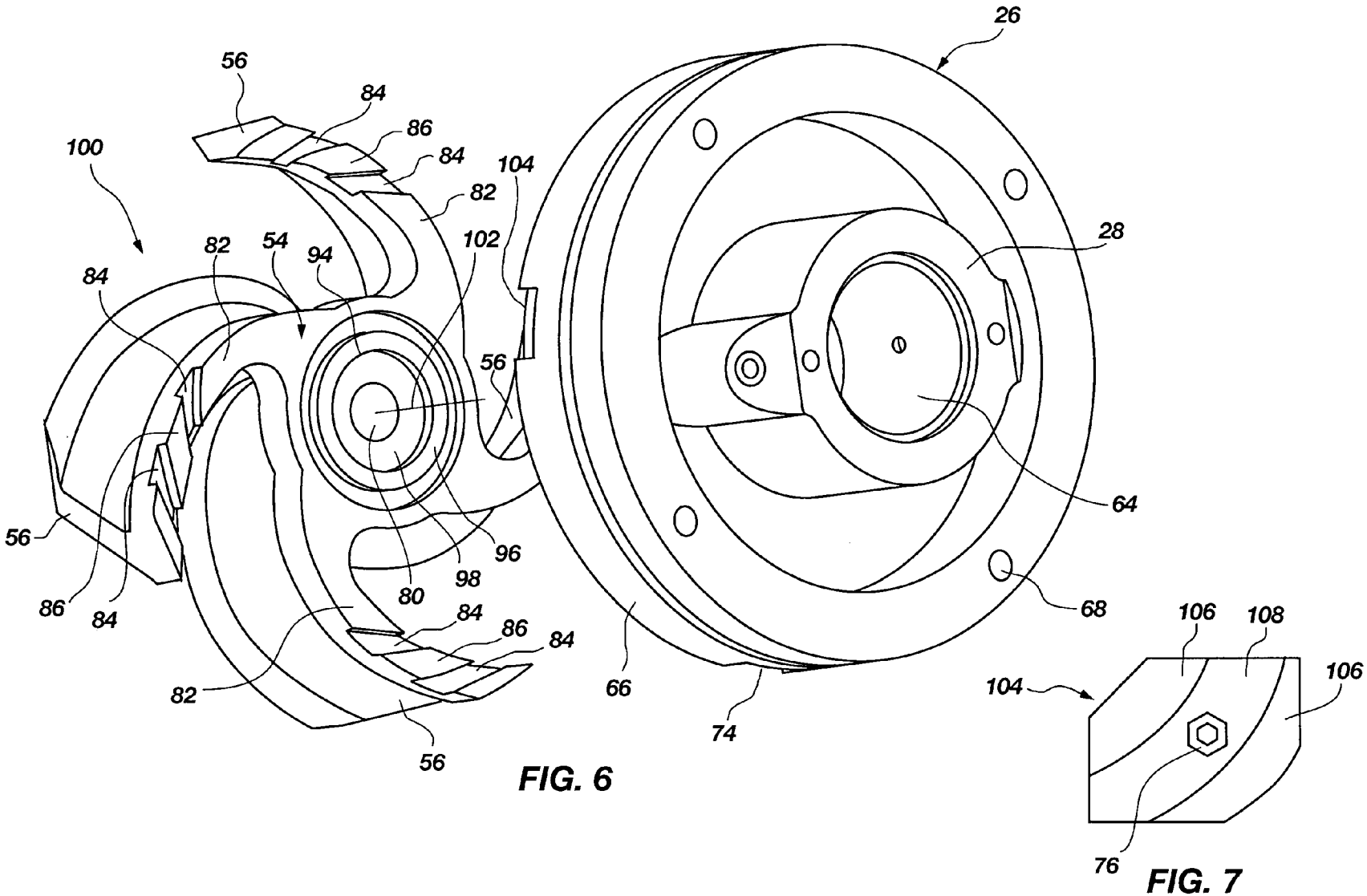
FIG. 6 is a perspective and exploded view of the drive side of an alternative impeller embodiment of the present invention.
FIG. 7 is an enlarged view of an alternative embodiment of a back plate cutting element for use with the impeller embodiment illustrated in FIG. 6.

The invention has heretofore been described and illustrated in terms of an impeller 10 having a shroud 58. FIG. 6 illustrates an alternative embodiment of the present invention where the impeller 100 is open, or has no shroud. The impeller 100 in this embodiment has a plurality of vanes 56 which radiate outwardly from a central axis 102 of the impeller 100 and curve as they radiate from the central axis 102. On the drive side surface 54 of the impeller 100, each vane 56 may further be structured with an expeller vane 82 that extends axially in the direction of the back plate 26.

Indentations 84 are formed near the periphery of the impeller 100 along the expeller vanes 82, thereby providing impeller cutter teeth 86 positioned near the periphery of the impeller 100. In this embodiment, the indentations 84 are curved, rather than linear as shown in the embodiment of FIG. 3. Correspondingly, the impeller cutter teeth 86 are curved as well. However, the indentations 84 and impeller cutter teeth 86 may be linear as previously described.

The back plate 26 in the embodiment shown in FIG. 6 is essentially identical to the back plate 26 as previously described with respect to FIGS. 2 and 3. However, as shown in FIG. 7, the studs 104 are correspondingly configured to interact with the curved impeller cutter teeth 86 of the impeller 100. Thus, the studs 104 are formed with curved cutter teeth 106 which are spaced from each other by a curved channel 108 which is appropriately configured and curved to receive the impeller cutter teeth 86 therein as the impeller 100 rotates against the back plate 26. Again, studs 104 of the embodiment shown in FIGS. 6 and 7 are hardened to resist wear, but are replaceable when worn. Alternatively, the back plate cutter teeth 106 of this embodiment may be integrally formed with the back plate 26 in the manner previously described.

The shroudless impeller 100 may also be configured with debris excluding structure near the central axis 102 of the impeller as previously described with respect to the embodiment of FIGS. 2 and 3. The debris excluding structure, again, may be a labyrinth 90 structure which comprises a series of annular rings 96 and indentations 94 which produce a plurality of angled turns that the debris and fluid must negotiate in order to reach the drive shaft of the pump. The debris excluding structure positioned more in proximity to the central axis 102 of the impeller 100 may, however, be any suitable structure or configuration that facilitates elimination of debris from near the drive shaft.

In normal operation, the interaction between the impeller cutter teeth 86 and the back plate cutter teeth 70, 106 cause an eventual wearing of both, and a gap forms between the interacting cutting elements. The impeller may then be axially adjusted relative to the back plate to lessen the gap between the impeller cutter teeth and back plate cutter teeth. Eventually with continued operation, however, the cutter teeth of both the impeller and the back plate become sufficiently worn so that the impeller must be replaced or the cutting elements on the back plate or on the impeller, or both, must be replaced.

The impeller assembly of the present invention, comprising the impeller with peripheral cutting structures and interacting cutting elements on the pump casing or on a back plate, is particularly suited for use in centrifugal pumps of the chopper type, but may be adapted for use in any type of centrifugal or slurry pump. Because the configuration of chopper pumps, and centrifugal pumps in general, vary widely, it will be apparent to those of skill in the art what modifications may be required to adapt the invention to various pumps. Thus, reference herein to particularly described or illustrated details of the invention are merely by way of example and not by way of limitation.

What is claimed is:

1. An impeller assembly for a centrifugal pump, comprising:

an impeller having a suction side, a drive side, a central opening for attachment to a drive mechanism and a circumferential edge;

at least one vane positioned on said suction side of said impeller;

at least one interdented cutting structure positioned on said drive side of said impeller positioned proximate said circumferential edge; and at least one adjacently positioned interdented cutting element positioned for intermeshing interaction with said at least one interdented cutting structure of said impeller to effect cutting of solids near said circumferential edge on said drive side of said impeller.

2. The impeller assembly of claim 1 wherein said impeller further comprises debris excluding structure positioned in proximity to said central opening.

3. The impeller assembly of claim 2 wherein said debris excluding structure positioned in proximity to said central opening is configured as a labyrinth.

4. The impeller assembly of claim 1 wherein said at least one adjacently positioned interdented cutting element is configured for attachment to the pump casing of a pump.

5. The impeller assembly of claim 1 wherein said impeller assembly further comprises a back plate configured for attachment to the pump casing of a pump, and said at least one adjacently positioned interdented cutting element is attached to said back plate.

6. The impeller assembly of claim 5 wherein said at least one adjacently positioned interdented cutting element further comprises a back plate cutting body having cutting teeth that intermesh with said interdented cutting elements of said impeller, said back plate cutting body being integrally formed with said back plate.

7. The impeller assembly of claim 5 wherein said at least one adjacently positioned interdented cutting element further comprises a back plate cutting body having cutting teeth that intermesh with said cutting elements of said impeller, said back plate cutting body being formed as removably attached structures that detachably attach to said back plate.

8. The impeller assembly of claim 1 wherein said impeller further comprises a shroud.

9. The impeller assembly of claim 1 wherein said impeller further comprises at least one expeller vane positioned on said drive side of said impeller to expel solids away from said drive side of said impeller in a direction away from near said central opening.

10. An impeller for a centrifugal chopper pump, comprising:

an impeller having a central axis, a periphery, a suction side and a drive side;

at least one vane extending radially outwardly relative to said central axis on said suction side of said impeller; and at least one interdented cutting element positioned on said drive side of said impeller in proximity to said periphery thereof.

11. The impeller of claim 10 further comprising debris excluding structure spaced from said periphery toward said central axis for effecting exclusion of solids on said drive side of said impeller from a region proximate said central axis.

12. The impeller of claim 10 further comprising at least one expeller vane positioned on said drive side to expel solids away from said central axis of said impeller.

13. The impeller of claim 12 wherein said at least one interdented cutting element is structured as part of said at least one expeller vane.

14. The impeller of claim 10 further comprising a central opening formed through said drive side, an annular shoulder extending radially from said central opening, an annular ring extending axially from said drive side and positioned adjacent said annular shoulder and an annular channel positioned adjacent to and about said annular ring and being radially spaced from said annular ring.

15. The impeller of claim 14 further comprising at least one expeller vane positioned on said drive side of said impeller to expel solids in a direction away from said central opening.

16. A centrifugal pump having a pump casing and a drive mechanism, comprising:

an impeller having a central opening for attachment to a drive mechanism of a pump, a periphery and a drive side, said impeller having at least one vane radiating outwardly from a central axis of said impeller;

at least one interdented cutting structure positioned on said drive side of said impeller located proximate said periphery of said impeller; and at least one cutting element positioned adjacent said at least one interdented cutting structure of said impeller, said at least one interdented cutting element being structured and positioned to interact with said at Least one interdented cutting structure of said impeller to effect cutting of solids near the periphery, and on said drive side, of said impeller.

17. The centrifugal pump of claim 16 further comprising debris excluding structure positioned near said central opening.

18. The centrifugal pump of claim 17 wherein said debris excluding structure positioned near said central opening comprises a labyrinth.

19. The centrifugal pump of claim 16 wherein said at least one interdented cutting element positioned adjacent said at least one cutting structure of said impeller is secured to a portion of the pump casing of the pump.

20. The centrifugal pump of claim 16 further comprising a back plate positioned adjacent said drive side of said impeller, and wherein said at least one interdented cutting element positioned adjacent said at least one cutting structure of said impeller is positioned on said back plate.

21. The centrifugal pump of claim 20 wherein said at least one interdented cutting element is integrally formed to said back plate.

22. The centrifugal pump of claim 20 wherein said at least one interdented cutting element is detachably attached to said back plate.

23. The centrifugal pump of claim 16 further comprising at least one expeller vane positioned on said drive side of said impeller to expel solids from said drive side of said impeller in a direction away from said central opening.

* * * * *